US006669055B1

(12) United States Patent
Coleman et al.

(10) Patent No.: US 6,669,055 B1
(45) Date of Patent: Dec. 30, 2003

(54) HOLDER FOR VISCOUS FLUID DISPENSER

(76) Inventors: Thomas J. Coleman, 19170 Paddock Pl., Abingdon, VA (US) 24211-6776; William K. Schlotter, IV, 117 Wateredge La., Fredericksburg, VA (US) 22406-4336; Princess Ann Coleman, 19170 Paddock Pl., Abingdon, VA (US) 24211-6776; Ann M. Schlotter, 117 Wateredge, Fredericksburg, VA (US) 22406-4336

( * ) Notice: Subject to any disclaimer, the term of this patent is extended or adjusted under 35 U.S.C. 154(b) by 0 days.

(21) Appl. No.: 10/224,487

(22) Filed: Aug. 21, 2002

(51) Int. Cl.[7] ..... B65D 35/28
(52) U.S. Cl. ..... 222/103
(58) Field of Search ..... 222/103

(56) References Cited

U.S. PATENT DOCUMENTS 1,320,275 A 10/1919 Roach
1,507,464 A * 9/1924 Clegg ..... 222/103
1,773,577 A 8/1930 Eide
1,876,489 A * 9/1932 Collins ..... 222/103
2,210,226 A * 8/1940 Weisberger ..... 222/103
2,291,282 A 7/1942 Hollenbeck
3,418,059 A 12/1968 Robe
4,326,647 A * 4/1982 Pool ..... 222/103
5,007,987 A 4/1991 Block et al.
5,680,966 A 10/1997 Johnson
5,842,604 A 12/1998 Stahley et al.
6,315,165 B1 * 11/2001 Regan ..... 222/103

* cited by examiner

*Primary Examiner*—Kenneth Bomberg
(74) *Attorney, Agent, or Firm*—Clyde I Coughenour

(57) ABSTRACT

A dispenser holder discharges fluid from a dispenser using rigid pressure plates that have one of their ends pivotably secured together and that extend outwardly on opposing sides of the dispenser. Levers pivotably extend on opposing sides of the rigid pressure plates for pressing the plates against the sides of the collapsible dispenser.

17 Claims, 1 Drawing Sheet

HOLDER FOR VISCOUS FLUID DISPENSER

BACKGROUND OF THE INVENTION

1. Field of the Invention

A holder, for collapsible viscous fluid dispensers, opens a closure, inserts a dispenser, closes the closure to hold the dispenser, applies pressure to the sides of the dispenser using rigid plates pressed by levers to discharge viscous fluid, and opens the closure to remove the dispenser.

2. Description of Related Art

The use of multiple collapsible viscous fluid dispensers for decorating cakes, discharging different colors for painting, applying adhesives, lotions, etc. is common. Typically discharge is brought about by finger and thumb pressure applied on opposite sides of the collapsible dispenser. The result is an uneven pressure applied along the dispenser and the need to hold the dispenser in one hand while running the thumb and finger of the other hand to discharge residual fluid.

It has been proposed to provide rigid members on either side of collapsible containers to press on the containers for discharge. Examples of these are U.S. Pat. No. 1,320,275, issued Aug. 19, 1930 to O. Eide; U.S. Pat. No. 2,291,282, issued Jul. 28, 1942 to E. Hollenbeck; and U.S. Pat. No. 3,418,059, issued Dec. 24, 1968 to H. Robe. It has also been proposed to wind up such containers; U.S. Pat. No. 5,097, 987, issued Mar. 24, 1992 to R. Liberatore, and to press the contents from the bottom of the container; U.S. Pat. No. 5,842,604 issued Dec. 1, 1998 to R. Stahley et al, and to apply air pressure to force the contents from the container; U.S. Pat. No. 5,680,966, issued Oct. 28, 1997 to R. Johnson.

SUMMARY OF THE INVENTION

A dispenser holder provides for easy insertion and removal of fluid dispensers and one hand discharge with the only contact with the dispenser necessary being that of the cap. The dispensers are inserted and held in place by a hinged closure. The dispenser holder has pivoted rigid pressure plates that press on opposite sides of a dispenser under forces applied by levers pivoted within the dispenser holder housing on one end while the other ends that extend out from the housing are pressed inward by hand applied force.

DESCRIPTION OF THE PREFERRED EMBODIMENTS

The holder of the invention is designed to rapidly change from one dispenser to another, so as not to mess the fingers or hand, and to permit one hand dispensing. Pressure is applied equally along the sides of the collapsible container for uniform discharge while at the same time, due to the pressure plates being joined at their lower ends, working up from the bottom.

Figure 1:
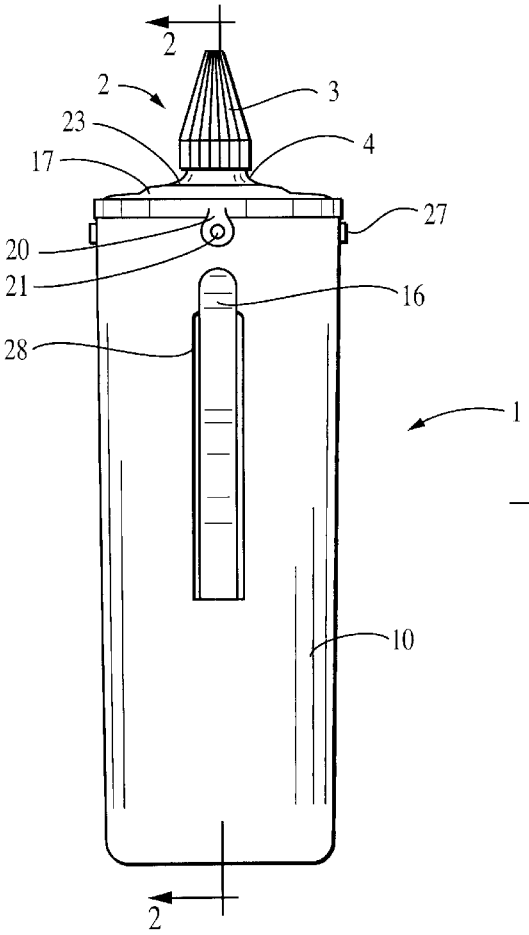
FIG. 1 is a front elevational view of the dispenser holder holding a dispenser.
Figure 2:
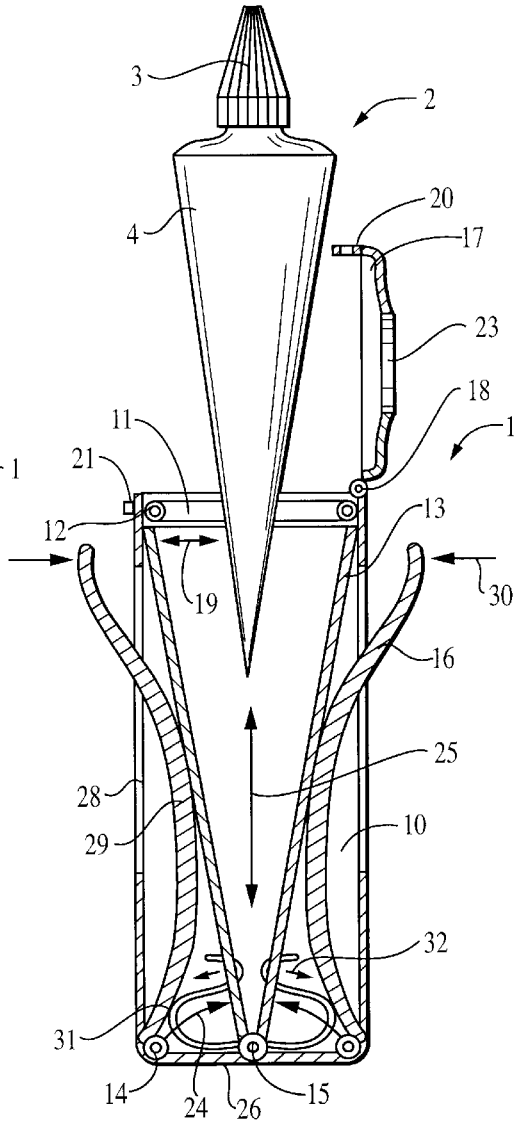
FIG. 2 is a side cross-sectional elevational view along section lines 2—2 of FIG. 1 with the holder closure open and a dispenser shown half way in the dispenser holder.

FIGS. 1 and 2 show elevational views of the dispenser holder 1 of the invention. FIG. 1 is a front view of the dispenser holder having a dispenser 2 secured within the holder. The holder housing 10 encloses pressure plates for discharging fluid from the dispenser. Pressure is applied manually by force applied to levers 16, that protrude outwardly through vertical passages 28 that are provided in the housing. The dispenser 2 is held within the dispenser holder 1 by a hinged holding closure 17 that has an essentially central opening 23 through which the dispenser cap 3 and a portion of the collapsible tube 4 upper extreme passes. The holding closure covers the upper outer portion of the collapsible tube and is secured in that position by any convenient securing means. As shown, a protrusion 21 on the housing 10 has an apertured snap-fastener 20 releasably forced over it to hold the closure 17 and dispenser 2 within the dispenser holder 1.

FIG. 2 is a cross-sectional elevational view of the holder side taken along the section lines 2—2 of FIG. 1 with the lid open and with the dispenser half way in the holder. The holding closure is shown open for reception or removal 25 of the dispenser 2. This is done by lifting the snap-fastener 20 on the closure second side off of the protrusion 21 and swinging the holding closure 17 about the closure first side hinge 18. In this position, a used dispenser 2 can be lifted out and/or a new dispenser inserted 25. A new dispenser is inserted between the pressure plates 13 in the interior central area of the housing with the levers first upper end 16 extending outwardly. With the dispenser in the holder, the holding closure 17 is lowered so as to insert the cap and upper dispenser central area through the opening 23 in the holding closure. The holding closure is then secured over the dispenser by snapping the fastener 20 over the protrusion 21.

The pressure plates 13 are secured within holder housing 10. The lower first ends of the pressure plates are pivotably secured to the housing base 26 central area by a plate hinge 15. The upper second ends of the pressure plates 13 are secured to slide pins 12. The outer ends of the slide pins 12 are free to reciprocate 19 in guide slots 11 at either side of the dispenser holder housing 10 upper end. The slide pins are held in place on either end by positioning washers 27. To force the pressure plates together 24 about the plate hinge 15, levers 16 second upper ends are forced inwardly 30. The lower first ends of the levers are pivoted about hinges 14 on either side end of the housing base 26. These hinges position and hold the lever lower first ends separated and fixed in position. The levers 16 extend arcuately inwardly and upwardly and then outwardly and upwardly with the arcuate central area 29 in contact with the pressure plates 13. The upper second ends of the levers extend out beyond the sides of the housing 10 through vertical passages 28. The arcuate central areas 29 of the levers press on the pressure plates 13 in a combined rolling sliding action as the levers 16 are pressed inwardly 30. Elongated, vertical passages 28, in either side of the housing 10, provide for the inward and outward movement of the levers 16 about the pivots 14 through the housing sides. The levers are pressed inwardly until the desired amount of fluid is discharged.

After the compressible tube 2 is inserted, the cap 3 is removed and the contents of the tube discharged, completely or to the extent desired, then the cap can be replaced on the tube. The holding closure is then opened to permit removal of one tube and insertion of another. The dispenser holder permits use of different dispensers with the only necessary contact of the dispenser being that of its cap.

To assist opening or separation of the pressure plates 13, after the collapsible tube 4 is removed, one or more weak springs are provided. A known type coil spring (not shown) can be positioned in or on the plate hinge 15 with its opposite ends extending out to press on the pressure plates lower inner ends. A wire or leaf spring 31 is shown wrapped around the plate hinge 15 with opposite curved sides extending outwardly and then upwardly and then inwardly with the respective ends fixed to the pressure plates to apply an outward force against the pressure plates.

It is believed that the construction, operation and advantages of this invention will be apparent to those skilled in the art. It is to be understood that the present disclosure is illustrative only and that changes, variations, substitutions, modifications and equivalents will be readily apparent to one skilled in the art and that such may be made without departing from the spirit of the invention as defined by the following claims.

What is claimed is:

1. A dispenser holder comprising:

a housing having an upper end and a lower end and a central interior area for reception of a dispenser having a first side and a second side;

a closure means for holding the dispenser within said housing;

pressure plates having a first end and a second end within said housing;

lever means having a first end and a second end and a mid-section within said housing for applying a force against said pressure plates;

said pressure plates first ends are pivotably secured together;

said pressure plates extend outwardly from said pivotably secured ends to receive the dispenser;

said pressure plates second ends are free to move toward and away from each other;

said pressure plates second ends movement is confined by slots formed in said housing upper end.

2. A dispenser holder as in claim 2 wherein:

said pressure plates second ends are secured to slide pins that move in said slots formed in said housing upper ends.

3. A dispenser holder as in claim 2 wherein:

A spring extends between said pressure plates tending to force said pressure plates apart.

4. A dispenser holder comprising:

a housing having an upper end and a lower end and a central interior area for reception of a dispenser having a first side and a second side;

a closure means for holding the dispenser within said housing;

lever mean having first end and a second end and a mid-section within said housing for applying a force against said pressure plates;

said lever means first end is pivotably secured within said housing lower end;

said lever means and said pressure plates have relative movement with respect to one another;

said lever means has an arcuately shaped mid-section contacting said pressure plates such that pivoting said lever toward said housing central area applies a force against said pressure plates.

5. A dispenser holder as in claim 4 wherein:

said lever means consists of two levers placed on opposite sides of said pressure plates within said housing.

6. A dispenser holder as in claim 5 wherein:

said pressure plates second ends movement is confined by slots formed in said housing upper end.

7. A dispenser holder as in claim 6 wherein:

said lever means second ends extend outwardly from said housing through vertical slots in said housing sides.

8. A dispenser holder as in claim 4 wherein:

said closure means has an essentially centrally located opening for passing a dispenser cap and for abutting a dispenser upper surface.

9. A dispenser holder as in claim 8 wherein:

said closure means has a first side and a second side;

said closure means first side is hinged to said housing upper end for opening and closing access to said housing interior.

10. A dispenser holder as in claim 9 wherein:

said closure means second side has a latching means for releasably securing said closure means to said housing upper end.

11. A dispenser holder comprising:

a housing having an upper end and lower end and a central interior area for reception of a dispenser having a fist side and a second side;

a closure means for holding the dispenser within said housing;

pressure plates having a first end and a second end within said housing;

lever means having a first end and a second end and mid-section within said housing for applying a force against said pressure plates;

said pressure plates first ends are pivotably secured together;

said pressure plates extend outwardly from said pivotably secured ends to receive the dispenser;

said pressure plates second ends are free to move toward and away from each other;

said lever means first end is pivotally secured within said housing lower end;

said lever means and said pressure plates have relative movement with respect to one another;

said lever means has an arcuately shaped mid-section contacting said pressure plates such that pivoting said lever toward said housing central area applies a force against said pressure plates.

12. A dispenser holder as in claim 11 wherein:

said lever means consists of two levers placed on opposite sides of said pressure plates within said housing;

said pressure plates first ends are pivotably secured between the location said two levers are pivotably secured, with all three pivotably secured to a housing base at said housing lower end.

13. A dispenser holder as in claim 11 wherein:

said pressure plates second ends movement is confined by slots formed in said housing upper end;

said pressure plates second ends are secured to slide pins that move in said slots formed in said housing upper ends.

14. A dispenser holder as in claim 13 wherein:

said closure means has an essentially centrally located opening for passing a dispenser cap and for abutting a dispenser upper surface;

said closure means first side is hinged to said housing upper end for opening and closing access to said housing interior;

said closure means second side has a latching means for releasably securing said closure means to said housing upper end.

15. A dispenser holder as in claim 11 wherein:

said pressure plates second ends movement is confined by slots formed in said housing upper end;

said lever means second ends extend outwardly from said housing through vertical slots in said housing side.

16. A dispenser holder as in claim 15 wherein:

said pressure plates second ends is (are) confined by slots in said housing upper end;

said pressure plates second ends are secured to slide pins that move in said slots formed in said housing upper ends.

17. A dispenser holder as in claim 15 wherein:

said closure means has an essentially centrally located opening for passing a dispenser cap and for abutting a dispenser upper surface;

said closure means first side is hinged to said housing upper end for opening and closing access to said housing interior;

said closure means second side has a latching means for releasably securing said closure means to said housing upper end.

* * * * *